US005908816A

United States Patent [19]

Kobessho et al.

[11] Patent Number: 5,908,816

[45] Date of Patent: Jun. 1, 1999

[54] METAL WORKING OIL COMPOSITION

[75] Inventors: Masahiro Kobessho; Komei Matsumoto, both of Ichihara, Japan

[73] Assignee: Idemitsu Kosan Co., Ltd., Tokyo, Japan

[21] Appl. No.: 08/986,642

[22] Filed: Dec. 8, 1997

[30] Foreign Application Priority Data

Dec. 11, 1996 [JP] Japan ..... 8-330491

[51] Int. Cl.[6] ..... C10M 159/24

[52] U.S. Cl. ..... 508/391; 72/42; 508/398

[58] Field of Search ..... 508/391, 398; 72/42

[56] References Cited

U.S. PATENT DOCUMENTS

| | | | |
|---|---|---|---|
| 2,943,052 | 6/1960 | Carlyle et al. | 508/398 |
| 3,813,337 | 5/1974 | Sheldahl | 508/398 |
| 4,283,294 | 8/1981 | Clarke | 508/391 |
| 4,659,488 | 4/1987 | Vinci | 508/391 |
| 5,256,322 | 10/1993 | Cohu . | |
| 5,599,780 | 2/1997 | Koyama et al. | 508/391 |
| 5,726,130 | 3/1998 | Yamanaka | 508/398 |

FOREIGN PATENT DOCUMENTS

| | | |
|---|---|---|
| 0 295 108 | 12/1988 | European Pat. Off. . |
| 0 622 443 | 11/1994 | European Pat. Off. . |
| 0 725 129 | 8/1996 | European Pat. Off. . |
| WO 88/02771 | 4/1988 | WIPO . |
| WO 95/32267 | 11/1995 | WIPO . |

OTHER PUBLICATIONS

Abstract of JP08020790A, Jan. 23, 1996.

*Primary Examiner*—Jacqueline V. Howard
*Attorney, Agent, or Firm*—Oblon, Spivak, McClelland, Maier & Neustadt, P.C.

[57] ABSTRACT

The present invention is directed to a metal working oil composition comprising the following components (A), (B), and (C), and optionally (D):

(A): a lubrication base oil, (B): 0.1–30% by weight of an overbasic alkaline earth metal sulfonate with respect to the total weight of the composition, (C): 0.1–30% by weight of an overbasic alkali metal sulfonate with respect to the total weight of the composition, and (D): 0–30% by weight of a sulfur-containing extreme-pressure agent.

6 Claims, No Drawings

METAL WORKING OIL COMPOSITION

BACKGROUND OF THE INVENTION

1. Field of the Invention

The present invention relates to a metal working oil composition, and more particularly to a metal working oil composition, which is suitable for metal working processes such as cutting and grinding.

2. Description of the Related Art

Generally speaking, in metal working processes such as cutting and grinding, chlorine-based extreme pressure agents have been used because of their excellent ability to improve cutting performance and relatively low cost.

However, in recent years, water-insoluble cutting fluids containing chlorine-based extreme pressure agents have been criticized as responsible for corrosion and damage of incinerators caused by environmental pollution and emission of chlorine gases, as dioxin is generated during incineration of waste.

Moreover, chlorinated paraffins, a class of chlorine-based extreme pressure agents, raise some concern about their toxicity and carcinogenicity.

In view of the foregoing, there have been developed oil compositions that do not contain chlorine-based extreme pressure agents.

For example, Japanese Patent Application Laid-Open (kokai) Nos. 6-313182 and 6-330076 disclose cutting oil compositions containing a sulfonate of an alkali metal and/or an alkaline earth metal. However, the cutting oil compositions actually disclosed in those publications—although applicable to turning and boring—are problematic when used in low-speed, heavy cutting in which the cutting speed is not more than 40 m/min.; e.g., broaching or gun-drilling, as they induce breakage of tools due to cutting force unless considerable amounts of such compositions are used or the working conditions are set to extremely mild.

SUMMARY OF THE INVENTION

The present invention was made from the above-mentioned standpoint, and the general object of the present invention is to provide a metal working oil composition which does not contain a chlorine-based extreme pressure agent and which can be adapted to low speed, heavy cutting such as broaching and gun-drilling. Since the composition of the present invention does not emit harmful gases when incinerated, environmental pollution or damage of incinerators can be advantageously resolved.

The present inventors conducted careful studies, and found that when an overbasic alkaline earth metal sulfonate and an overbasic alkali metal sulfonate are used in combination, the object of the invention can be attained, along with, surprisingly enough, an additional effect of enhanced cutting performance, thus leading to completion of the invention.

Accordingly, in one aspect of the present invention, there is provided a metal working oil composition comprising the following components (A), (B), and (C):

(A): a lubrication base oil, (B): 0.1–30% by weight of an overbasic alkaline earth metal sulfonate with respect to the total weight of the composition, and (C): 0.1–30% by weight of an overbasic alkali metal sulfonate with respect to the total weight of the composition.

In another aspect of the present invention, there is provided a metal working oil composition comprising the following components (A), (B), and (C):

(A): 60–99.8% by weight of a lubrication base oil, preferably a sulfurized mineral oil, (B): 0.1–30% by weight of an overbasic alkaline earth metal sulfonate, and (C): 0.1–30% by weight of an overbasic alkali metal sulfonate, wherein all proportions are based on the total weight of the composition.

In a further aspect of the present invention, there is provided a metal working oil composition further comprising the following component (D):

(D): 0–30% by weight of a sulfur-containing extreme-pressure agent.

MODES FOR CARRYING OUT THE INVENTION

Next will be described modes for carrying out the present invention.

The metal working oil composition of the present invention contains (A) a lubrication base oil, (B): an overbasic alkaline earth metal sulfonate in an amount of 0.1 –30% by weight with respect to the total weight of the composition, and (C) an overbasic alkali metal sulfonate in an amount of 0.1–30% by weight with respect to the total weight of the composition.

(A) Lubrication base oil

As a lubrication base oil of the present invention, mineral oil(s) and/or synthetic oil(s) are used. No particular limitation is imposed on the mineral oil(s) and/or synthetic oil(s), and those generally used as base oils of metal working oils may be used. The lubrication base oil preferably has a kinematic viscosity of 1–100 $mm^2/s$, more preferably 3–50 $mm^2/s$, at 40° C. When kinematic viscosity of the base lubrication base oil is excessively high, oily substances come to adhere easily onto a material to be worked, leading to an economically disadvantageous increase in the quantity of oily substances exhausted from the machine concomitant with the material after working (concomitant oily substance quantity). In contrast, in the case in which kinematic viscosity is excessively low, mist easily generates to lower operation efficiency disadvantageously. Although there is no particular limitation as to the pour point—which serves as an index for the low temperature fluidity—of the lubrication base oil, the pour point is preferably not higher than −10° C. Several types of mineral oils and synthetic oils are usable, and they are suitably selected in accordance with use, etc. Examples of mineral oils include distillates obtained through atmospheric distillation of paraffin base crude oils, intermediate base crude oils, or naphthene base crude oils, and distillates obtained through reduced-pressure distillation of residual oils resulting from atmospheric distillation. Alternatively, there may be used refined oils obtained by subjecting these distillates to a conventional refining process. Examples of such refined oils include solvent-refined oils, hydrogenation-refined oils, dewaxed oils, and clay-treated oils.

Furthermore, so-called sulfurized mineral oils are also preferably used. The sulfurized mineral oils are obtained through reaction of a mineral oil and sulfur; generally, 0.1–1 part by weight of sulfur is added to 100 parts by weight of a mineral oil so as to cause a reaction at 120–130° C. for 10 minutes to 1 hour. There is no particular limitation as to sulfur used in the present invention. Examples of sulfur include natural sulfur and sulfur by-produced from desulfurization of natural gas or petroleum fractions. The kinematic viscosity of the sulfurized mineral oil(s) at 40° C. preferably falls within the same viscosity range of the above mentioned mineral oils.

Examples of synthetic oils include poly-α-olefin, α-olefin copolymers, polybutene, alkylbenzene, polyol esters, dibasic acid esters, polyoxyalkylene glycols, polyoxyalkylene glycol esters, polyoxyalkylene glycol ethers, and silicone oils. In addition to sulfurized mineral oils, sulfurized synthetic oils may also be preferably used.

These lubrication base oils may be used singly or in combination of two or more species, and a mineral oil and a synthetic oil may be used in combination.

The lubrication base oil of the present invention is employed in an amount of 60–99.8% by weight, preferably 80 –99% by weight, with respect to the total weight of the composition.

When there is used a lubrication base oil having a relatively low viscosity represented by a kinematic viscosity of not more than about 20 $mm^2/s$ at 40° C., addition of a polymer having, for example, a number average molecular weight of about 2,000–300,000 to a metal working oil composition effectively suppresses generation of mist during metal working. Examples of the polymer include polymethacrylate, polyisobutylene, and olefin copolymers such as ethylene-propylene copolymers, styrene-butadiene copolymers, and styrene-isoprene copolymers.

The polymer is incorporated into the composition in an amount of 0.01–20% by weight, more preferably 0.1–10% by weight, of the total weight of the composition, although the amount may vary in accordance with the molecular weight or characteristics of the lubrication base oil. Amounts less than 0.01% by weight may not satisfactorily suppress generation of mist, whereas if the amount is in excess of 20% by weight, viscosity rises to permit larger amounts of oily substances to be exhausted from the working machine concomitant with the material to be worked.

(B) Overbased alkaline earth metal sulfonate

The overbased alkaline earth metal sulfonate (B) used in the present invention denotes various alkaline earth metal sulfonate salts and can generally be obtained through carbonation of the corresponding alkaline earth metal sulfonate. Examples of sulfonic acids in the present invention include aromatic petroleum sulfonic acid, alkylsulfonic acid, arylsulfonic acid, and alkylarylsulfonic acid, more specifically, dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid, and naphthalenesulfonic acid. Examples of alkaline earth metals include calcium, barium, and magnesium, with calcium being preferred. The compounds may be used singly or in combination of two or more species.

The overbased alkaline earth sulfonate is used in an amount of 0.1–30% by weight, preferably 0.5–15% by weight, of the total weight of the composition. Amounts less than 0.1% by weight may not maintain sufficient workability in cutting or grinding, whereas amounts in excess of 30% by weight may not always provide improvements commensurate with the amount.

Overbased alkaline earth metal sulfonates used in the present invention preferably have a total base value of 200 –800 mgKOH/g (JIS K-2501: by a perchloric acid method), more preferably 300–600 mgKOH/g. Sufficient workability in cutting or grinding may not be assured when the total base value of an overbasic alkaline earth sulfonate is lower than 200 mgKOH/g. On the other hand, amounts in excess of 800 mgKOH/g reduce the solubility of the overbased alkaline earth metal sulfonate in a lubrication base oil to possibly result in precipitation of the sulfonate in the working oil.

(C) Overbased alkali metal sulfonate

The overbased alkali metal sulfonate (C) in the present invention denotes various alkali metal sulfonate salts and can be obtained through carbonation of the corresponding alkali metal sulfonate in general. Examples of sulfonic acids are the same as those which are used in preparation of overbased alkaline earth metal sulfonates. Examples of alkali metals include sodium, potassium, and cesium, with sodium being preferred.

In the present invention, component (C) may be used singly or in combination of two or more species. Component (C) is used in an amount of 0.1–30% by weight, preferably 0.5–15% by weight, of the total weight of the composition. Amounts less than 0.1% by weight may reduce workability in cutting or grinding, whereas amounts in excess of 30% by weight may not always provide improvements commensurate with the amount.

Moreover, the ratio by weight of component (B) to component (B), i.e. , component (B)/component (B), i s preferably 0.001–1, more preferably 0.01–0.75, and most preferably 0.1–0.70, in view of synergism.

Overbased alkali metal sulfonates used in the present invention preferably have a total base value of 200–800 mgKOH/g (JIS K-2501: by the perchloric acid method), more preferably 300–600 mgKOH/g. When the total base value of overbased alkali sulfonate is lower than 200 mgKOH/g, workability in cutting or grinding may not be assured. On the other hand, amounts in excess of 800 mgKOH/g reduce the solubility of the overbased alkaline earth metal sulfonate in a lubrication base oil to possibly result in precipitation of the sulfonate in the working oil.

The metal working oil composition of the present invention preferably contain s a component (D), sulfur-containing extreme pressure agent, so as to enhance cutting performance.

(D) Sulfur-containing extreme pressure agent

The component (D), i.e., a sulfur-containing extreme pressure agent, is not particularly limited so long as it contains sulfur atom(s) in the molecule and is dissolved in or homogeneously dispersed in a lubrication base oil to function as an extreme pressure agent. Examples of extreme pressure agents include sulfurized oils and fats, sulfurized fatty acids, sulfurized esters, sulfurized olefins, dihydrocarbyl polysulfides, thiocarbamates, thioterpenes, and dialkyl thiodipropionates. The sulfurized oils and fats used in the present invention are obtained through reaction of sulfur or a sulfur-containing compound and a oil or fat (lard, whale oil, vegetable oil, fish oil, etc.) and contain 5–30% by weight of sulfur in general. Examples of sulfurized oils and fats include sulfurized lard, sulfurized rape seed oil, sulfurized castor oil, sulfurized soybean oil, and sulfurized rice bran oil. Examples of sulfurized fatty acids include sulfurized oleic acid. Examples of sulfurized esters include a methyl ester of sulfurized oleic acid and an octyl ester of sulfurized rice bran fatty acid.

Examples of sulfurized olefins include compounds represented by following formula (I):

$$R^1—S_x—R^2 \quad (I)$$

wherein $R^1$ is a C2–C15 alkenyl group; $R^2$ is a C2–C15 alkyl or alkenyl group; X is an integer between 1 and 8 inclusive. This compound is obtained through reaction of C2–C15 olefin or a dimer, trimer, or tetramer thereof and a sulfurizing agent such as sulfur and sulfur chloride. Preferable examples of olefins in the present invention include propylene, isobutene, and diisobutene.

Examples of dihydrocarbyl polysulfides include a compound represented by the following formula (II):

$$R^3—S_y—R^4 \quad (II)$$

wherein each of $R^3$ and $R^4$, which may be identical to or different from each other, a C1–C20 alkyl or cycloalkyl group, a C6–C20 aryl group, a C7–C20 alkylaryl group, or a C7–C20 arylalkyl group; and y is an integer between 2 and 8 inclusive.

Examples of $R^3$ and $R^4$ in formula (II) include a methyl group, an ethyl group, a n-propyl group, an isopropyl group, a n-butyl group, an isobutyl group, a sec-butyl group, a tert-butyl group, a pentyl group, a hexyl group, a heptyl group, an octyl group, a nonyl group, a decyl group, a dodecyl group, a cyclohexyl group, a cyclooctyl group, a phenyl group, a naphthyl group, a tolyl group, a xylyl group, a benzyl group, and a phenethyl group.

Preferable examples of the dihydrocarbyl polysulfides include dibenzyl polysulfide, di-tert-nonyl polysulfide, didodecyl polysulfide, di-tert-butyl polysulfide, dioctyl polysulfide, diphenyl polysulfide, and dicyclohexyl polysulfide.

Furthermore, exemplary useful thiocarbamates are led by zinc dithiocarbamate; exemplary useful thioterpenes are led by reaction products of phosphorus pentasulfide and pinene; and exemplary useful thiodipropionates are led by dilauryl thiodipropionate and distearyl thiodipropionate.

Among them, dihydrocarbyl polysulfides are preferred in view of extreme pressure characteristics, etc.

In the present invention, the above-described sulfur-containing extreme-pressure agents may be used singly or in combination of two or more species.

The sulfur-containing extreme pressure agents are generally used in amounts of 0–30% by weight, preferably 0.1–20% by weight, with respect to the total weight of the composition. When the sulfur-containing extreme-pressure agents are used in amounts in excess of 30% by weight, extreme-pressure characteristics and stability against oxidation of the metal working fluid tend to decrease.

In the present invention, the total base number of the composition is preferably adjusted to fall within the range of 1–75 mgKOH/g (JIS K-2501; by the perchloric acid method), more preferably 3–30 mgKOH/g. If the total base number is less than 1 mgKOH/g, cutting workability and grinding workability may become poor, whereas if it is larger than 75 mgKOH/g, solubility of components (B), (C), or (D) in the lubrication base oil decreases to permit these components to precipitate in the working fluid.

The composition of the present invention is prepared by incorporating components (B), (C), and optionally (D), into the lubrication base oil (A). Usually, however, so as to secure the essential performance of a metal working fluid, a variety of known and suitable additives may also be incorporated within certain amounts that will not impede the intended effect of the invention. Examples of the additives include phosphorus-containing extreme pressure agents such as phosphoric acid esters and phosphorus acid esters. The phosphorus-containing extreme-pressure additives are generally contained in amounts of 0.05–20% by weight, preferably 0.5–10% by weight, based on the total weight of the composition. Examples of other additives include oiliness-imparting agents such as carboxylic acid (e.g., oleic acid, stearic acid, and dimeric acid) and esters thereof; antiwear agents such as zinc dithiophosphates (Zn-DTP, excepting those of the aryl type), zinc dithiocarbamates (ZnDTC), sulfated oxymolybdenum dithiocarbamate (MoDTC), Ni-dithiophosphate (NiDTP), and Ni-dithiocarbamate (NiDTC); antioxidants of the amine-type, phenol-type, etc.; metal-inactivating agents such as thiadiazole and benzotriaozle; sludge dispersants such as alkenylsuccinic acid or esters and imides thereof; rust-preventive agents such as sulfonates, phenates, and salicylates of neutral alkaline earth metals and sorbitan esters; and defoamers such as dimethylpolysiloxane and polyacrylate.

EXAMPLES

The present invention will next be described in detail by way of examples, which should not be construed as limiting the invention.

Example 1 through 4 and Comparative Examples 1 through 5

The ingredients shown in Table 1 and Table 2 were incorporated into a lubrication base oil at proportions as indicated, to thereby prepare a cutting fluid composition of the present invention (shown as "Ex. 1" etc.) and comparative cutting fluid compositions (shown as "Comp. Ex. 1," etc.). By use of these compositions, the below-described groove-cutting test was performed, and the working performance of each of the cutting fluids was evaluated. The results are also shown in Table 1.

Groove-cutting Test

Groove-cutting was performed under the conditions described below. From the cutting force (primary force & feed force) in two-dimensional cutting and the frictional coefficient of tool rake, working performance of the oil composition was evaluated.

Cutting conditions

Cutting speed: 3–5 m/min.

Feed speed: 0.025 mm/rev.

Material subjected to cutting: JIS SUS 440 C

Cutting tool:

Byte: Toshiba Tungalloy SCTH

Tip: Toshiba Tungalloy CTN3K (cemented carbide K10)

Rake angle: 8°, Relief angle: 6°

TABLE 1

| Formulation ratio (wt. %) | Ex. 1 | Ex. 2 | Ex. 3 | Ex. 4 |
|---|---|---|---|---|
| Minerai oil #1 | — | 91 | 91 | 91 |
| Sulfurized minerai oil *2 | 91 | — | — | — |
| Overbased Ca-sulfonate *3 | 1 | 1 | 1 | 1 |
| Overbased Na-sulfonate *4 | 3 | 3 | 3 | 3 |
| Polysulfide *5 | 5 | 5 | — | — |
| Sulfurized olefin *6 | — | — | 5 | — |
| Sulfurized ester *7 | — | — | — | 5 |
| Total base number of the composition (mgKOH/g) | 17 | 17 | 17 | 17 |
| Mean primary force (N) | 255 | 279 | 282 | 284 |
| Mean feed force (N) | 132 | 155 | 162 | 163 |
| Frictional coefficient of tool rake | 0.71 | 0.76 | 0.78 | 0.78 |

(Note)

*1 A refined oil obtained by refining a distillate obtained through distillation of parafinic base crude oil (kinematic viscosity: 10 $mm^2/s$ at 40° C.)

*2: A reaction product of a paraffin base mineral oil and pulverized sulfur (sulfur content; 0.5 wt. %, kinematic viscosity: 10 $mm^2/s$ at 40° C.)

*3: Total base number: 400 mgKOH/g

*4: Total base number: 448 mgKOH/g

*5: di-tert-nonyl polysulfide

*6: A reaction product of a isobutene and sulfur

*7: Methyl ester of sulfurized oleic acid

TABLE 2

| Formulation ratio (wt. %) | Comp. Ex. 1 | Comp. Ex. 2 | Comp. Ex. 3 | Comp. Ex. 4 | Comp. Ex. 5 |
|---|---|---|---|---|---|
| Mineral oil *1 | — | — | — | 92 | 92 |
| Sulfurized mineral oil *2 | 92 | 92 | 85 | — | — |
| Overbased Ca-sulfonate *3 | — | 3 | — | 3 | — |
| Overbased Na-sulfonate *4 | 3 | — | 10 | — | 3 |
| Polysulfide *5 | 5 | 5 | 5 | 5 | 5 |
| Total base number of the composition (mgKOH/g) | 13 | 12 | 45 | 12 | 13 |
| Mean primary force (N) | 274 | 267 | 268 | 291 | 294 |
| Mean feed force (N) | 153 | 145 | 142 | 172 | 175 |
| Frictional coefficient of tool rake | 0.76 | 0.74 | 0.72 | 0.80 | 0.80 |

(Note)
*1: A refined oil obtained by refining a distillate obtained through distillation of parafinic base crude oil (kinematic viscosity: 10 $mm^2/s$ at 40° C.)
*2: A reaction product of a paraffin base mineral oil and pulverized sulfur (sulfur content; 0.5 wt. %, kinematic viscosity: 10 $mm^2/s$ at 40° C.)
*3: Total base number: 400 mgKOH/g
*4: Total base number: 448 mgKOH/g
*5: di-tert-nonyl polysulfide As is apparent from Table 1, the composition of Example 1 exhibited improved properties with respect to both the absolute value of cutting force and frictional coefficient.

As described above, the metal working oil composition of the present invention, containing no chlorine-base extreme pressure agents, does not emit a harmful gas during incineration treatment, raises no problem in terms of environmental pollution or damage of incinerators. In addition, the composition is suitably adapted to low-speed, heavy cutting such as broaching and gun-drilling.

What is claimed is:

1. A metal working oil composition comprising a sulfurized mineral oil obtained through reaction of a mineral oil and sulfur, 0.1–30% by weight of an overbasic alkaline earth metal sulfonate with respect to a total weight of the composition, and 0.1–30% by weight of an overbasic alkali metal sulfonate with respect to the total weight of the composition.

2. A metal working oil composition comprising a lubrication base oil, 0.1–30% by weight of an overbasic alkaline earth metal sulfonate with respect to a total weight of the composition, 0.1–30% by weight of an overbasic alkali metal sulfonate with respect to the total weight of the composition, and 0.1–30% by weight of a sulfur-containing chlorine-free extreme-pressure agent with respect to the total weight of the composition.

3. The metal working composition according to claim 1, wherein the sulfurized mineral oil is obtained by reacting from 0.1 to 1 part by weight of sulfur with 100 parts by weight of a mineral oil at a temperature in a range of from 120 to 130° C. for a period of time of from 10 minutes to 1 hour.

4. The metal working oil composition according to claim 1, wherein said overbasic alkaline earth metal sulfonate has a total base value of from 200 to 800 mgKOH/g and said overbasic alkali metal sulfonate has a total base value of from 200 to 800 mgKOH/g.

5. The metal working oil composition according to claim 2, wherein said overbasic alkaline earth metal sulfonate has a total base value of from 200 to 800 mgKOH/g and said overbasic alkali metal sulfonate has a total base value of from 200 to 800 mgKOH/g.

6. The metal working oil composition according to claim 2, comprising 5–30% by weight of the sulfur-containing chlorine-free extreme-pressure agent with respect to the total weight of the composition.

* * * * *